United States Patent [19]

Kull

[11] 4,062,596

[45] Dec. 13, 1977

[54] LOCKING DEVICE FOR PNEUMATIC OUTLET REQUIRING TOOL TO OPEN THE END CAP

[75] Inventor: George A. Kull, St. Charles, Mo.

[73] Assignee: ACF Industries, Incorporated, New York, N.Y.

[21] Appl. No.: 706,476

[22] Filed: July 19, 1976

[51] Int. Cl.[2] ..... B65G 53/36

[52] U.S. Cl. ..... 302/52; 138/89; 220/318; 220/322; 292/210; 292/DIG. 49

[58] Field of Search ..... 302/52; 214/83.28; 292/DIG. 49, 210, 108; 220/318, 322; 138/89

[56] References Cited

U.S. PATENT DOCUMENTS

| | | | |
|---|---|---|---|
| 2,950,143 | 8/1960 | Koranda et al. | 302/52 |
| 3,023,451 | 3/1962 | Thoel | 292/210 |
| 3,090,519 | 5/1963 | Koranda et al. | 302/52 |
| 3,167,222 | 1/1965 | Koranda | 302/52 |
| 3,306,675 | 2/1967 | Fritz | 302/52 |
| 3,439,956 | 4/1969 | Ingram et al. | 302/52 |
| 3,583,768 | 6/1971 | Koranda | 302/52 |
| 3,588,181 | 6/1971 | Nagy | 302/52 |
| 3,715,053 | 2/1973 | Carter | 220/322 |
| 3,761,135 | 9/1973 | Mundinger et al. | 302/52 |
| 3,778,114 | 12/1973 | Carney et al. | 302/52 |

*Primary Examiner*—John J. Love
*Assistant Examiner*—Jeffrey V. Nase
*Attorney, Agent, or Firm*—Henry W. Cummings

[57] ABSTRACT

In a pneumatic outlet a "U" shaped bail assembly is pivotally mounted on at least one end wall of the outlet. The bail assembly includes a pair of arms which extend outwardly from the end wall beyond the discharge tube of the outlet, and a body portion which extends transverse to the longitudinal axis of the discharge tube and joins the arms. A locking handle is mounted on the body portion which is movable to a locking position to maintain the end cap in engagement with the discharge tube. A locking assembly mounted on one of the arms of the bail is movable between a position blocking movement of the locking handle from the locking position and a position allowing movement of the locking handle to the unlocked position. A fastener member carried by the locking assembly is operable to fasten the locking assembly in the handle blocking position.

2 Claims, 8 Drawing Figures

LOCKING DEVICE FOR PNEUMATIC OUTLET REQUIRING TOOL TO OPEN THE END CAP

BACKGROUND OF THE INVENTION

In some pneumatic outlets the end cap is held in place by bail assembly which is pivotally mounted on the end wall of the outlet. The bail assembly is "U" shaped including a pair of arms extending outwardly from the end wall beyond the discharge tube of the outlet. The arms are joined by a body portion which extends transverse to the longitudinal axis of the discharge tube. A removable end cap in closed position covers the end of the discharge tube. A locking handle is pivotally mounted upon the body portion of the bail. When the end cap is in closed position, the handle engages the external face of the end cap in a closed overcenter position to maintain the cap in place.

However, it has been found that when such bail assemblies have been utilized on railway car pneumatic outlets, when the railway cars have been parked in railway yards there has been a tendency for unauthorized personnel to move the locking handle from the closed position, raise the bail assembly, and tamper with or attempt to unload the outlet.

It therefore is desirable to provide a locking assembly to be used in conjunction with such a bail assembly whereby the locking handle cannot be moved from the closed position maintaining the end cap in place, without the assistance of an unlocking tool.

SUMMARY OF THE INVENTION

In a pneumatic outlet, a bail assembly is pivotally mounted on the end wall of the outlet. The bail assembly is "U" shaped, including a pair of arms which extend outwardly from the end wall beyond the discharge tube of the outlet. The arms are joined by a body portion which extend transverse to the longitudinal axis of the discharge tube. A removable end cap in closed position covers the end of the discharge tube. A locking handle is pivotally mounted on the body portion of the bail assembly. When the end cap is in closed position covering the discharge tube of the outlet, the locking handle is movable to a closed position to maintain the end cap in place on the discharge tube.

To prevent unauthorized persons from tampering with and/or unloading the outlet, a locking assembly is provided in which the locking handle can be moved from the closed position only with the aid of an unlocking tool. The bail assembly can then be raised and the end cap removed. The locking assembly includes a locking member which is pivotally mounted on a bracket extending from at least one bail arm. A locking portion of the locking member spaced from the pivot point engages the locking handle to maintain the locking handle in the closed position engaging the end cap. Fastening means are provided which in one position maintain the locking member in a closed position engaging the locking handle, and in a second position allow the locking member to be pivoted about the pivot point out of engagement with the locking handle. The handle can then be moved from the closed position. In one embodiment the fastening means includes at least one fastener which extends through a first opening provided in locking member and through a second opening provided in the bail arm. The fastener is provided with a head at one end for receiving an unlocking tool to unlock the handle. The other end of the fastener is provided with a protrusion transverse to the axis of the fastener which in locked position engages the inner surface of the bail arm. When the fastener is rotated by the unlocking tool the protrusion is movable through the second opening in the bail, allowing the fastener to be removed. The locking member may then be pivoted about the pivot point on the bracket allowing the handle to be manually removed from the closed position, the bail raised and the end cap removed. Preferably the protrusion on the fastener is not movable through the first opening in the locking handle so that the fastener will remain attached to the locking handle and will not be lost when the end cap is removed and the outlet is unloaded.

THE DRAWINGS

DESCRIPTION OF PREFERRED EMBODIMENT

Figure 1:
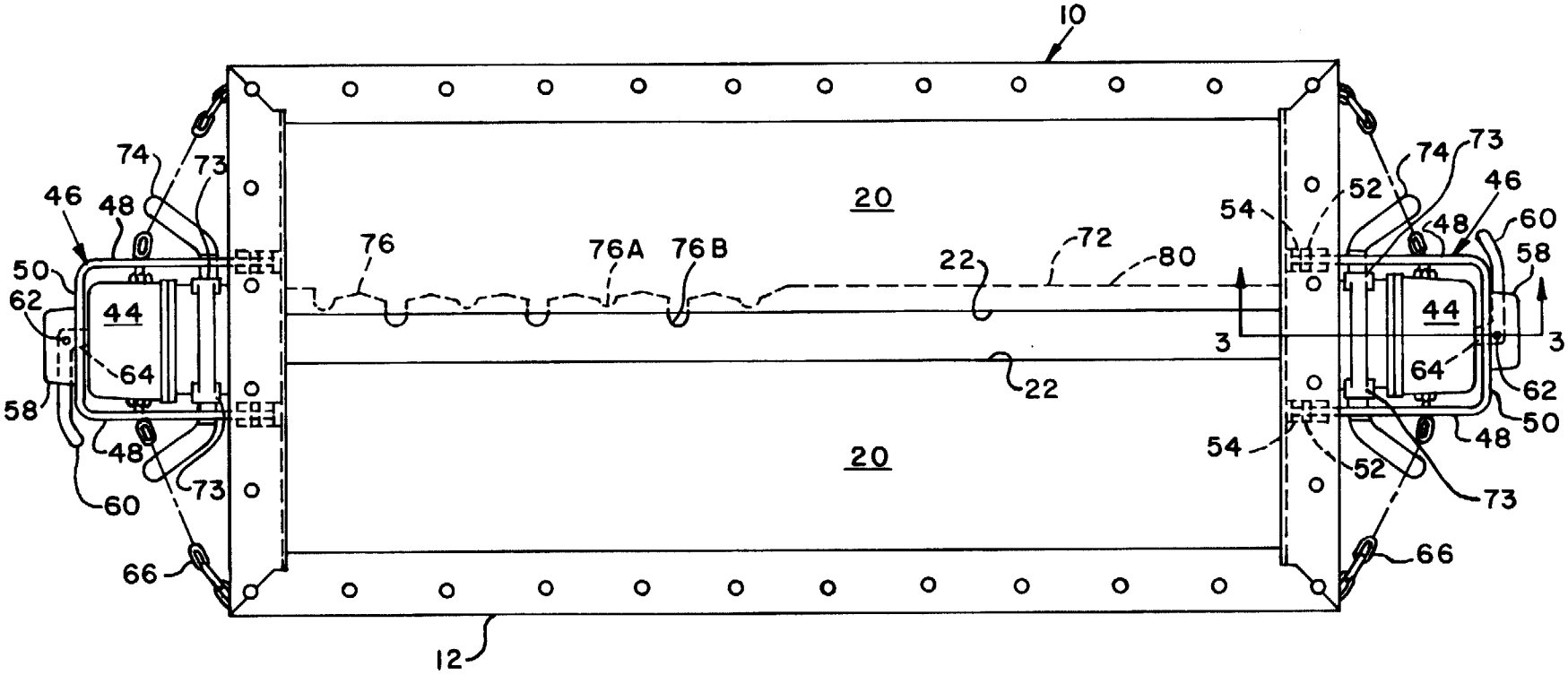
FIG. 1 Prior Art
FIG. 1 is a top plan of a pneumatic discharge outlet with which the locking assembly of the present invention may be used.

An example of a pnuematic discharge outlet to which the locking assembly of the present invention may be applied is found in U.S. Pat. No. 3,778,114 granted Dec. 11, 1973, assigned to the same assignee as the present application. Reference may be made to this patent for a detailed description of the operation of this pnuematic discharge outlet. It is sufficient for an understanding of the present invention to point that a pnuematic discharge outlet indicated at 10 includes an upper circumferential mounting flange 12 thereabout. A hopper structure shown at 14 in FIG. 2 includes a lower circumferential flange 16 thereon. A gasket 18 is positioned between flanges 12 and 16. Outlet structure 10 is suitably secured by nut and bolt combinations to hopper structure 14.

Figure 2:
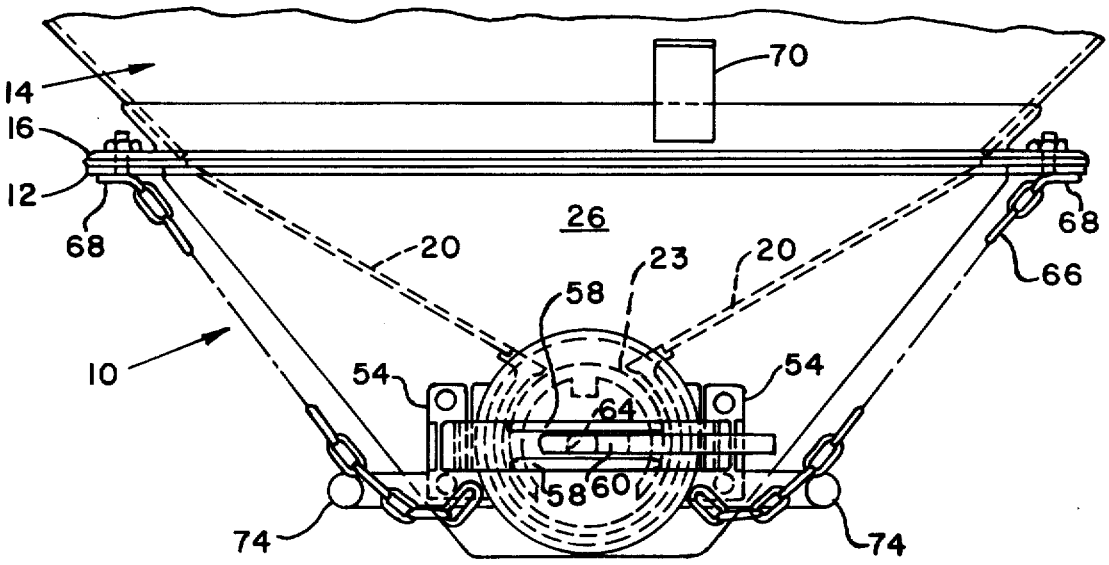
FIG. 2 Prior Art
FIG. 2 is an end elevation of the bottom outlet discharge structure in FIG. 1 illustrated as secured to the lower portion of a hopper.
Figure 3:
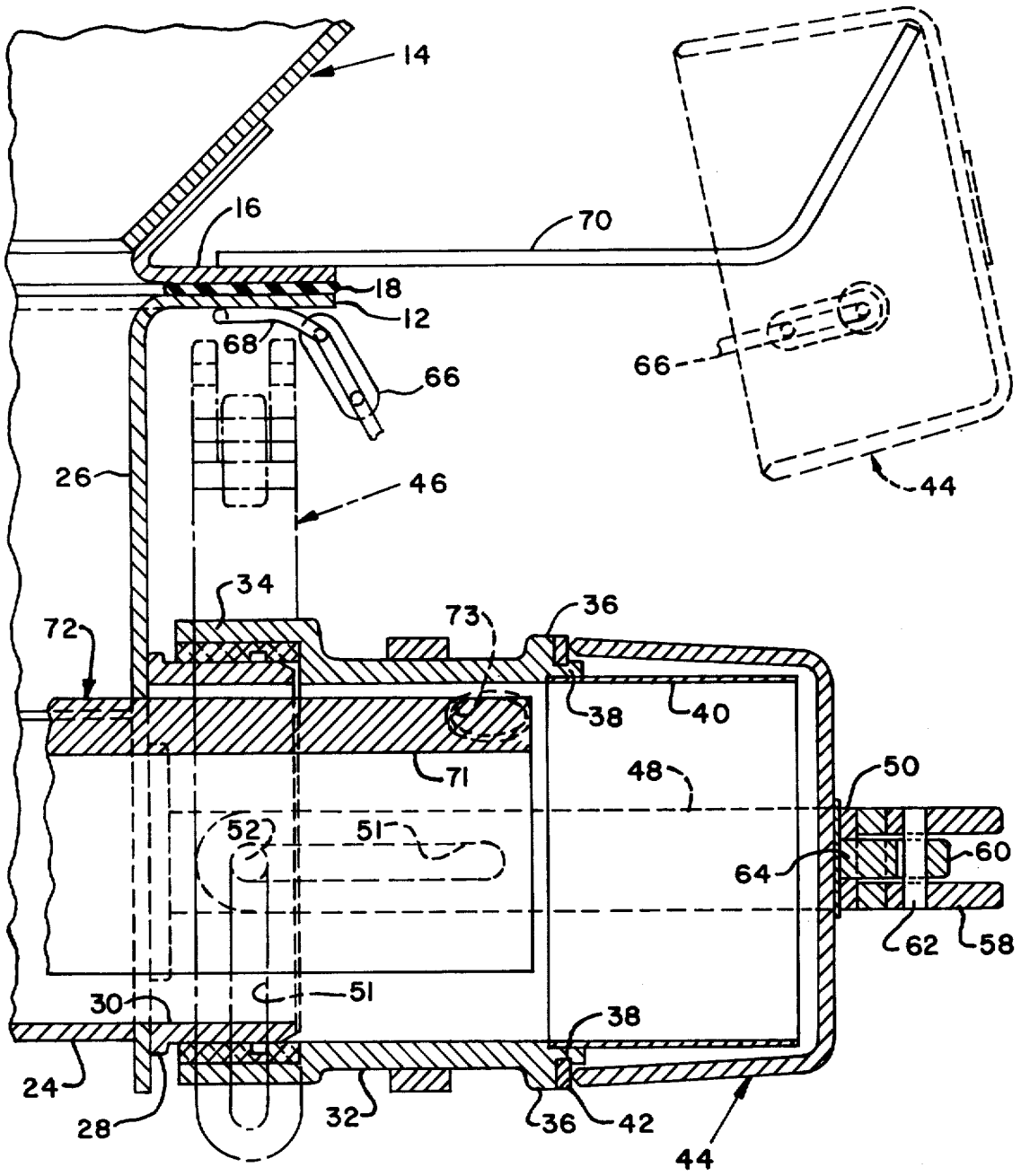
FIG. 3 Prior Art
FIG. 3 is an enlarged section taken generally along line 3—3 of FIG. 1.

Outlet 10 further includes a pair of side walls 20 sloping downwardly from flange 12 and including lower portions terminating in lips 22 defining an opening 23 thereabout (FIG. 2). A lower housing or discharge conduit 24 extends downwardly from lips 22 to provide a conduit for the discharge of lading. End walls 26 connect the ends of side walls 20. As shown in FIG. 3, fixed to each end wall 26 is an end ring 28. The inner surface 30 of end ring 28 is flush with the inner surface or bottom of conduit 24 to form a smooth continuation thereof. A discharge tube 32 is mounted on each bearing 34 which extends about end ring 28. Discharge tube 32 rotates freely about end ring 28. A circumferential rim 36 is provided on the outer end of discharge tube 32. An inner groove 38 receives an adapter fitting 40 to which a pneumatic hose or the like (not shown) may be connected for the pneumatic discharge of the lading from discharge outlet 10. A gasket 42 is positioned on the outer end of circumferential rim 36 and a removable end cap 44 may be positioned over adapter 40 adjacent gasket 42.

Figure 1A:
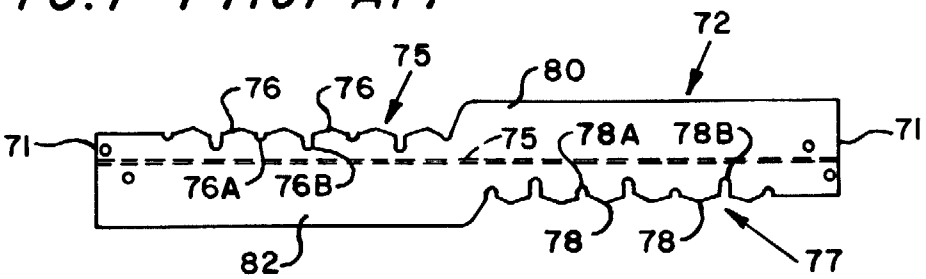
FIG. 1A is a plan view of the blank from which the valve member shown in FIG. 1 is made illustrating the openings in the valve member.

A valve member indicated generally at 72 in FIG. 1 includes end portions 71 which extend within discharge tubes 32. Valve member 72 includes a first valve opening 75 having series of teeth 76 arranged on one side of valve member 72, and a second opening 77 in FIG. 1A including a series of teeth 78 arranged on the opposite side of valve member 72.

Fasteners 73 (FIGS. 1 and 3) secure end portions 71 to the adjacent discharge tubes 32. Handles 74 are secured to each side of each discharge tube 32 and are adapted to be manually gripped for rotation of discharge tube 32 and valve member 72 to align openings 75 and 77 with opening 23 to unload the outlet as described in greater detail in U.S. Pat. No. 3,778,114.

Figure 5:
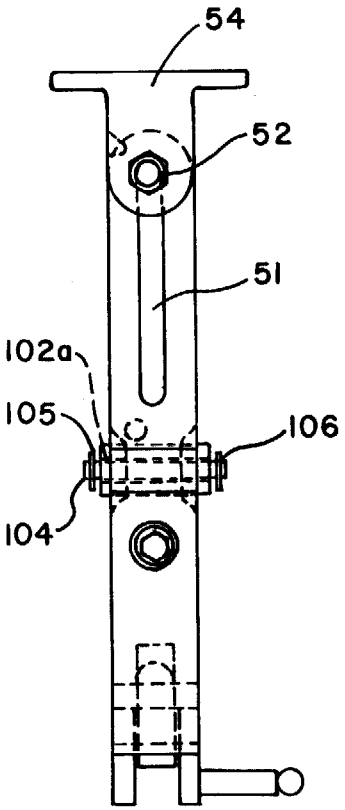
FIG. 5 is a side elevation view of FIG. 4.

For securing end cap 44 in position, a bail assembly generally indicated at 46 is provided having parallel arms 48 (FIGS. 1 and 4) connected by a transverse body portion 50. Arms 48 have slots 51 (FIGS. 3 and 5) receiving pins 52 in brackets 54 secured to end wall 26 (FIG. 2). A bracket 58 (FIGS. 1 — 4) on body portion 50 has a handle 60 pivotally mounted thereon about pivot 62. Handle 60 has a cam surface 64 (FIG. 4) adjacent one end thereof which is adapted to engage the outer surface of end cap 44 in a closed, overcenter position. A chain 66 (FIG. 1) is connected to the sides of end cap 44 and is anchored at 68 to the underside of circumferential flange 12. A strap or hanger 70 (FIG. 2) is secured to the upper surface of flange 16 and extends outwardly to provide a support for cap 44 when the cap is removed from the end of pneumatic outlet 10 as shown in FIG. 3.

When this outlet has been utilized on railway hopper cars and such cars have been parked in rail yards, occasionally unauthorized persons have moved handle 60 from its closed or overcenter position, pivoted bail arms 48 about brackets 54, removed end cap 44, and have attempted to unload the outlet in the rail yard. This can result in cars arriving at destination with reduced lading quantity, contamination of the lading, and possible injury to persons tampering with the outlet.

It therefore is desirable to provide a locking assembly for such outlets whereby the handle 60 cannot be moved from its closed position engaging end cap 44 without the aid of a suitable unlocking tool. Unauthorized persons in the yard who would have a tendency toward tampering with the outlet would usually not have access to such unfastening tools. On the other hand, most car receivers for whom the cars are destined would have available, or could readily obtain such an unfastening tool.

In accordance with the present invention, a bail locking assembly indicated generally at 100 is provided to maintain the bail assembly and the locking handle in closed position until released by a suitable unlocking tool. The locking assembly includes a bracket 102 which is mounted on an indentation 49 formed on the arm 48 adjacent the end 61 of handle 60. A locking member 103 is pivotally mounted on bracket 102 by means of a pin 104 extending through bracket opening **102*a*. The pin includes a head 105 and a cotter 106. A locking member 103 includes a curved portion 111 and a distal end 113 which engages locking handle 60 and maintains handle 60 in the closed overcenter position engaging end cap 44**.

Figure 4:
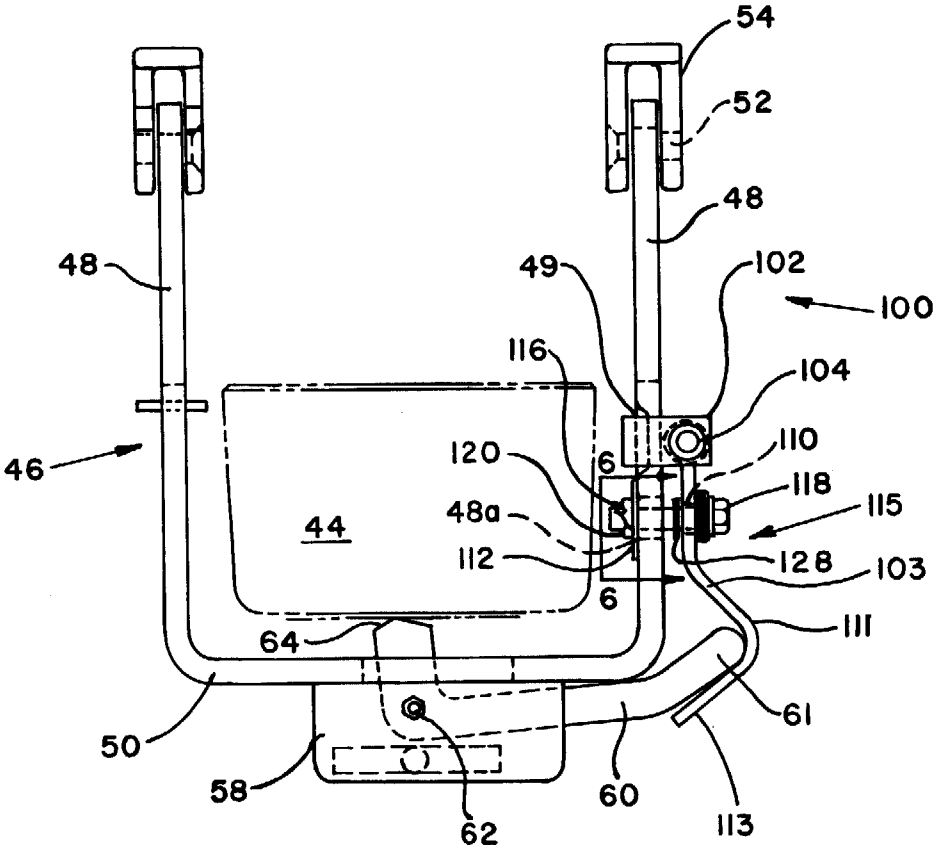
FIG. 4 is a plan view of the locking assembly of the present invention.
Figure 6A:
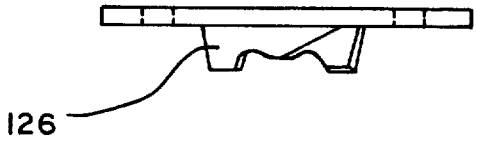
FIG. 6A is a plan view of a plate having a locking contour which may be utilized with the locking fastener in the locking assembly of the present invention.
Figure 6:
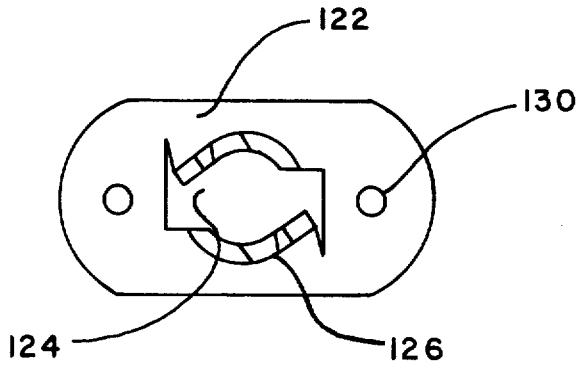
FIG. 6 is a sectional view looking in the direction of the arrows along the line 6—6 in FIG. 4.

A first opening 110 is provided in locking member 103. A second opening 112 is provided in arm 48. As shown in FIG. 4 this second opening is elongated along the longitudinal axis of bail arm 48. Fastening means indicated generally at 115 are provided movable to a first position to maintain locking arm 103 in engagement with handle 60, to maintain handle 60 in closed position engaging end cap 44 and movable to a second position in which locking arm may be pivoted about bracket 102 to an open position, at which position handle 60 may be moved from the closed position engaging end cap 44, whereby the bail assembly 46 may be raised and the end cap removed. In one embodiment a fastener 116 having a head 118 on one end and a locking protrusion 120 on the other end is inserted through the first opening 110 in locking member 103 and through the second opening 112 in arm 48. If desired, as shown in FIGS. 6 and 6A a plate 122 having an elongated opening 124 and a locking contour 126 may be applied to bail arm 48 with an appropriate fastener through openings 130. Examples of such plates and cooperating fastener 116 are found in Camloc Fastener Corporation, Division of Rexnord Corporation; Paramus, N.J.; Catalog No. 60, copyright 1960, pp 70 and 71. A suitable unlocking tool having a suitable gripping contour is applied to fastener head 118 to move protrusion 120 into a locked position engaging the inner surface **48*a* a of bail arm 48 and/or locking contour 126. The unlocking tool, for example, may be a wrench having adjustable jaws, or a wrench having a fixed contour of appropriate size to grip fastener head 118. A washer 128 attached to fastener 116 maintain the fastener captive on locking member 103**.

In operation, assuming that the bail assembly 46 and locking assembly 100 are in the closed position shown in solid lines in FIG. 4, to open the outlet the operator engages fastener head 118 with a suitable unlocking tool and rotates fastener 116 sufficiently for protrusion 120 to aling with slot **48*a* in arm 48, Fastener 116 may then be moved through the opening 48*a* in arm 48, and locking arm 103 may be pivoted outwardly about pin 104 in bracket 102. The distal end 113 of arm 103 thus no longer engages the end 61 of handle 60. Thus handle 60 may be pivoted from the closed position engaging end cap 44 about the pivot point 62, and bail assembly 46 raised. End cap 44 then may be removed from discharge tube 32, and the outlet unloaded as described in U.S. Pat. No. 3,778,114. During unloading, end cap 44 may be placed upon hanger 70 as shown in dotted lines in FIG. 3**.

After the outlet has been unloaded end cap 44 may be replaced on discharge tube 32 as shown in FIGS. 1 and 3. Bail assembly 46 is pivoted into the position shown in FIG. 2, and locking handle 60 is pivoted about the pivot point 62 with cam surface 64 engaging the external surface of end cap 44 in a closed preferrably overcenter position. Locking handle 103 is pivoted about point 104 into the position shown in solid lines in FIG. 4 With the distal end 113 engaging the end 61 of locking handle 60. The operator utilizes a suitable unlocking tool, of appropriate contour and size to rotate fastener 116 into the locked position, with protrusion 120 engaging the inner surface of bail arm 48.

In this closed position unauthorized persons in the rail yard are not able to pivot locking handle 60 about pivot point 62 unless a suitable unlocking tool is utilized.

What is claimed is:

1. In a pneumatic outlet having a "U" shaped bail assembly pivotally mounted on the end wall of the outlet, including a pair of arms which extend generally parallel to a discharge tube of the outlet extending outwardly from said end wall, and a bracket portion which extends generally transverse to the longitudinal axis of the discharge tube and is attached to said arms; a removable end cap which in closed position covers the end of the discharge tube; a locking handle pivotally mounted on said bracket portion which engages said end cap in a closed position; the locking handle being movable to a closed position to maintain the end cap in place on the discharge tube; the improvement comprising:

a locking assembly to prevent the locking handle from being moved from the closed position, the bail assembly raised and the end cap removed without the aid of an unlocking tool; said locking assembly including a locking member pivotally mounted on at least one bail arm; a distal end portion of the locking member engaging an end portion of said locking handle to maintain the locking handle in said closed position engaging the end cap; a fastener requiring an unlocking tool for operation extending through a first opening provided in the locking member and through a second opening provided in the bail arm; said fastener having a head at one end for receiving an unlocking tool, said fastener having at its other end a protrusion transverse to the axis of the fastener which in locked position engages the inner surface of the bail arm, substantially reducing the liklihood that the bail and end cap will be tampered with in rail yards, whereby when said fastener is engaged by an unlocking tool the fastener and protrusion are movable through the said second opening allowing the locking member to be pivoted about the pivot point, allowing the handle to be manually removed from the closed position, the bail assembly raised and the end cap removed; the protrusion on the fastener not being movable through said first opening so that the fastener will remain attached to the locking handle and will not be lost when the end cap is removed and the outlet is unloaded.

2. An outlet according to claim 1 wherein a plate is attached to said bail arm having an elongated opening which aligns with said second opening and includes a locking contour engageable by said protrusion in locked position.

* * * * *